US009296452B2

(12) United States Patent
Laboccetta

(10) Patent No.: US 9,296,452 B2
(45) Date of Patent: Mar. 29, 2016

(54) REMOVABLE DIVING WEIGHT

(71) Applicant: Mark Laboccetta, Virginia Beach, VA (US)

(72) Inventor: Mark Laboccetta, Virginia Beach, VA (US)

( * ) Notice: Subject to any disclaimer, the term of this patent is extended or adjusted under 35 U.S.C. 154(b) by 5 days.

(21) Appl. No.: 13/849,273

(22) Filed: Mar. 22, 2013

(65) Prior Publication Data

US 2014/0126963 A1 May 8, 2014

Related U.S. Application Data

(60) Provisional application No. 61/723,749, filed on Nov. 7, 2012.

(51) Int. Cl.
*B63C 11/30* (2006.01)

(52) U.S. Cl.
CPC ..... *B63C 11/30* (2013.01); *B63B 2241/10* (2013.01); *B63C 2011/306* (2013.01)

(58) Field of Classification Search
CPC .... B63C 11/02; B63C 11/30; B63C 2011/306
USPC ..... 405/185, 186, 187; 482/105
See application file for complete search history.

(56) References Cited

U.S. PATENT DOCUMENTS

| | | | | |
|---|---|---|---|---|
| 2,970,448 | A * | 2/1961 | Di Julio | 405/186 |
| 3,220,197 | A * | 11/1965 | Christiansen | 405/186 |
| 3,401,529 | A * | 9/1968 | Fifield | 405/186 |
| 3,851,488 | A * | 12/1974 | Schuler | 405/186 |
| 4,789,270 | A * | 12/1988 | Selisky | 405/186 |
| 4,848,965 | A * | 7/1989 | Peterson | 405/186 |
| 6,478,510 | B1 * | 11/2002 | Young | 405/186 |
| 2009/0317193 | A1 * | 12/2009 | Wang | 405/186 |

* cited by examiner

*Primary Examiner* — Benjamin Fiorello
(74) *Attorney, Agent, or Firm* — Andrew Olmsted

(57) ABSTRACT

A one-piece diving weight with openings to quickly add and remove the invention from a user's weight belt.

5 Claims, 4 Drawing Sheets

REMOVABLE DIVING WEIGHT

CROSS-REFERENCE TO RELATED APPLICATIONS

The present application claims priority of the U.S. Provisional Application 61/723,749 filed on Nov. 7, 2012 entitled "Removable Diving Weight," the contents of which are hereby incorporated by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of weights for underwater diving.

For the purposes of this application, diving can be broken down into two general categories: diving with self-contained underwater breathing apparatus (SCUBA) equipment and free diving. SCUBA divers rely on a self-contained air supply for prolonged underwater breathing. On a typical day of diving, SCUBA divers perform few dives (generally no more than 4) at a relatively consistent depth. Free divers on the other hand, take a breath on the surface of the water and dive underwater for as long as they are physically capable of holding their breath. While SCUBA divers have few dives at relatively consistent depths, free divers can perform hundreds of dives in a given day at a wide range of depths. The overwhelming majority of SCUBA divers and free divers wear wetsuits when in the water.

Divers strive to be neutrally buoyant at depth. When a user is diving with SCUBA diving gear, the user can adjust his or her buoyancy by adding and removing air to the user's buoyancy compensation device. Free divers do not utilize buoyancy compensation devices and must rely on their natural buoyancy, the buoyancy of their wetsuits and weights to achieve the required level of buoyancy necessary for any given diving conditions.

Wetsuits are inherently buoyant. Thicker wetsuits provide more buoyancy than thinner wetsuits. Thicker wetsuits require the use of more weight to counteract this buoyancy than thinner wetsuits. Wetsuits also compress at depth. As a diver dives deeper in the water, the water pressure compresses his or her wetsuit and he or she will no longer be as buoyant as in shallower dives. As a result, more weight is necessary for shallow dives than is necessary for deeper dives with an identical wetsuit. Because free divers dive in such a wide range of depths and in many locations in any given day, it is important for them to be able to easily add and remove weights to adjust to the conditions they are diving. Often times, divers will enter the water with too much weight or too little weight. This constitutes a safety hazard unless the diver returns to the boat or shore to remove his or her weight belt and adjust the weights accordingly until properly weighted.

Conventional diving weights are threaded through a weight belt worn around the user's midsection. To adjust the amount of weight, the user must first remove the weight belt before he or she can slide the weights on or off the weight belt. Doing so is a minor inconvenience when on shore or on a boat, but is very difficult to do while in the open water (which is where free-divers spend the majority of their dive days).

Prior art discloses diving weights that do not require the user to remove his or her weight belt to remove or attach diving weights.

The inventor performed a prior art search for quickly removable diving weights (ballasts) designed for wear on a standard weight belt for diving. The following U.S. patents of interest are:

| U.S. Pat. No.: | Issue Date: | Inventor |
|---|---|---|
| 4,789,270 | Dec. 6, 1988 | Selisky |
| 2,970,448 | Feb. 7, 1961 | Di Julio et al. |
| 3,039,273 | Jun. 19, 1962 | Swindell, et al. |
| 3,192,723 | Jul. 6, 1965 | Apperson, et al. |
| 3,220,197 | Nov. 30, 1965 | Christiansen et al. |
| 3,263,432 | Aug. 2, 1966 | Maskell et al. |
| 3,648,324 | Mar. 14, 1972 | Stradella el al. |
| 3,808,824 | May 7, 1974 | Johnston et al. |
| 3,851,488 | Dec. 3, 1974 | Schuler |
| 4,848,965 | Jul. 18, 1989 | Peterson |

Selisky (U.S. Pat. No. 4,789,270) teaches a one-piece diving weight designed for wear on a diving weight belt, where the belt is threaded through the weight and the weights cannot be added nor removed without removing the entire belt from the user's body. Selisky teaches an example of the most commonly-seen diving weight on the market.

Di Julio et al. (U.S. Pat. No. 2,970,448) teaches a one-piece rectangular diving weight designed for wear on a compressible diving weight belt, where the weight clamps the belt. The weights can be bolted together and may be removed without removing the entire belt from the user's body.

Swindell, et al. (U.S. Pat. No. 3,039,273) teaches a multi-piece diving weight designed for wear on a diving weight belt, where the user removes a yoke portion of the weight to release the weight from the diving belt. The user may remove the weight without removing the weight belt from his or her body.

Apperson, et al. (U.S. Pat. No. 3,192,723) teaches a one-piece diving weight designed for wear on a diving weight belt, with a U-shaped groove in the weight holding the weight in place on the belt. The user may remove the weight without removing the weight belt from his or her body.

Christiansen, et al. (U.S. Pat. No. 3,220,197) teaches a multi-piece diving weight designed for wear on a diving weight belt, where the user threads a standard diving weight belt through a channel and secures the weight on the belt with a holding pin. The user may remove the weight without removing the weight belt from his or her body.

Maskell, et al. (U.S. Pat. No. 3,263,432) teaches a multi-piece diving weight system comprising disc-shaped weights and a shoulder harness to attach the weights. The weights are held in place on the shoulder harness by threading the shoulder harness straps through the weights and securing the weights in place with a holding pin. The user may remove the weights without removing the harness from his or her body.

Stradella, et al. (U.S. Pat. No. 3,648,324) teaches a multi-piece diving weight system comprising a weight and a separate insert system, where the insert system functions as a quick release push button mechanism for attaching and removing the weight from a diving weight belt. The user may remove the weight system without removing the weight belt from his or her body.

Johnson, et al. (U.S. Pat. No. 3,808,824) teaches a multi-piece diving weight designed for wear on a diving weight belt comprising a weight with two embedded steel clips, the function of the clips to hold the weight on a diving weight belt. The user may remove the weight without removing the weight belt from his or her body.

Schuler (U.S. Pat. No. 3,851,488) teaches a multi-piece diving weight system comprising two separate weight-retaining cases, which are attached by a flexible attachment strap and clamp around a diving weight belt. The user may remove the weight system without removing the weight belt from his or her body.

Peterson (U.S. Pat. No. 4,848,965) teaches a multi-piece diving weight designed for wear on a diving weight belt comprising a lead body with an embedded steel hex nut to attach the weight to the users weight belt.

The inventor also performed a prior art search on the internet for one-piece diving weights (ballast) designed to be worn on a diving weight belt and removable without the necessity of removing the belt. The inventor found prior art including weights that may be removed from a diving weight belt without removing the belt. The prior art found includes weights designed to clip onto the user's diving gear with different attachment mechanisms (both moving and non-moving parts) and weights constructed of multiple-piece designs. The prior art found costs significantly more than the standard weight for diving exemplified by the Selisky patent (U.S. Pat. No. 4,789,270).

The inventor believes the present invention is an improvement over prior art because it may be produced for less than other diving weights on the market and consists of one molded piece of material. Furthermore, the inventor believes the present invention is less complex than the prior art and will be more desirable to the user. To attach the present invention to a weight belt, the user holds the weight at an angle roughly forty-five degrees off-center against his or her body and resting on top of a weight belt. Rotating the present invention roughly forty-five degrees back toward center and lightly pressing downward causes the invention to lock on to the weight belt, where it is held securely in place on the belt. Reversing this process allows the user to remove the present invention from a weight belt. The present invention is also an improvement over the prior art because it may be added and removed with one hand, whereas other inventions in the prior art require the use of both hands.

SUMMARY OF THE INVENTION

The present invention is a one-piece weight incorporating an attachment lip that allows the user to remove the weight relatively easily, while holding the weight in place on a weight belt when removal is not desired.

DETAILED DESCRIPTION OF THE INVENTION

The preferred embodiment of the present invention calls for a one-piece molded construction made of solid material with a density greater than that of water. The preferred embodiment of the present invention shares dimensions with those of standard-sized diving weights currently on the market. The preferred embodiment of the present invention calls for symmetrical construction.

Alternative embodiments of the present invention allow for construction of the present invention using other materials denser than water (>1.00 g/cm$^3$ at 4 degrees centigrade). Alternative embodiments of the present invention allow for non-symmetrical construction. Alternative embodiments of the present invention allow for sizes larger and smaller than the preferred embodiment. Alternative embodiments of the present invention may feature attachment points for a user to attach additional diving gear such as lights, knives and stringers.

Figure 1:
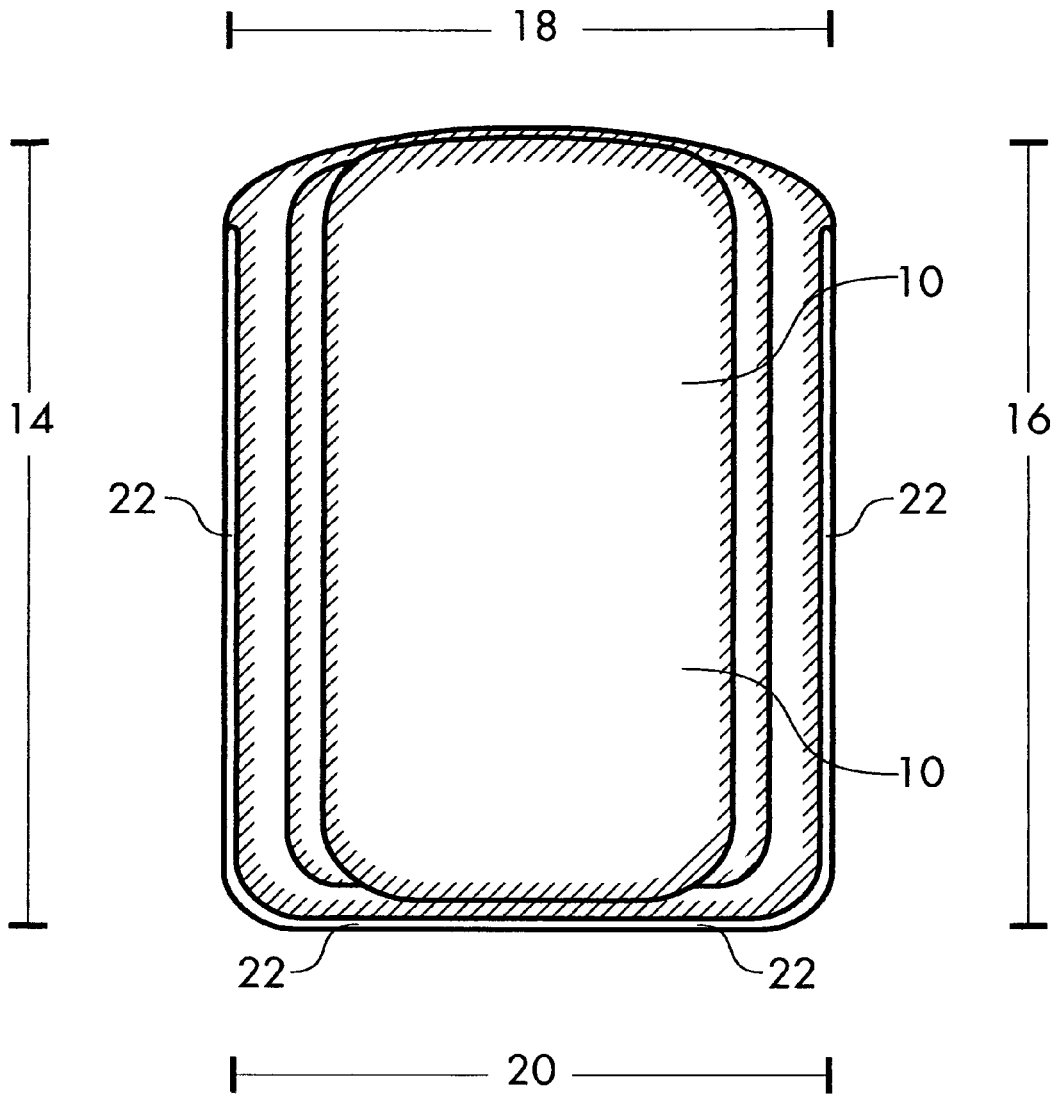
FIG. 1 is a view of the exterior portion of the invention.

Referring now to the view of the present invention as shown in FIG. 1, there is shown the exterior surface 10, left side 14, right side 16, top side 18, bottom side 20 and hollow belt channel 22. The preferred embodiment of the present invention calls for the user's weight belt to run through the hollow belt channel 22. When standing on dry land, the top side 18 of the present invention faces upward while the bottom side 20 faces downward. The exterior surface 10 of the present invention faces away from the user's body. The user's weight belt is worn around his/her waist. When standing on dry land, the solid construction of the top side 18 of the present invention keeps the invention resting firmly on the user's weight belt. When the user is diving in an inverted position, the invention is held in place on the user's weight belt by the support lip 24 near the bottom side 20, which will be elaborated on in subsequent FIGS.

Figure 2:
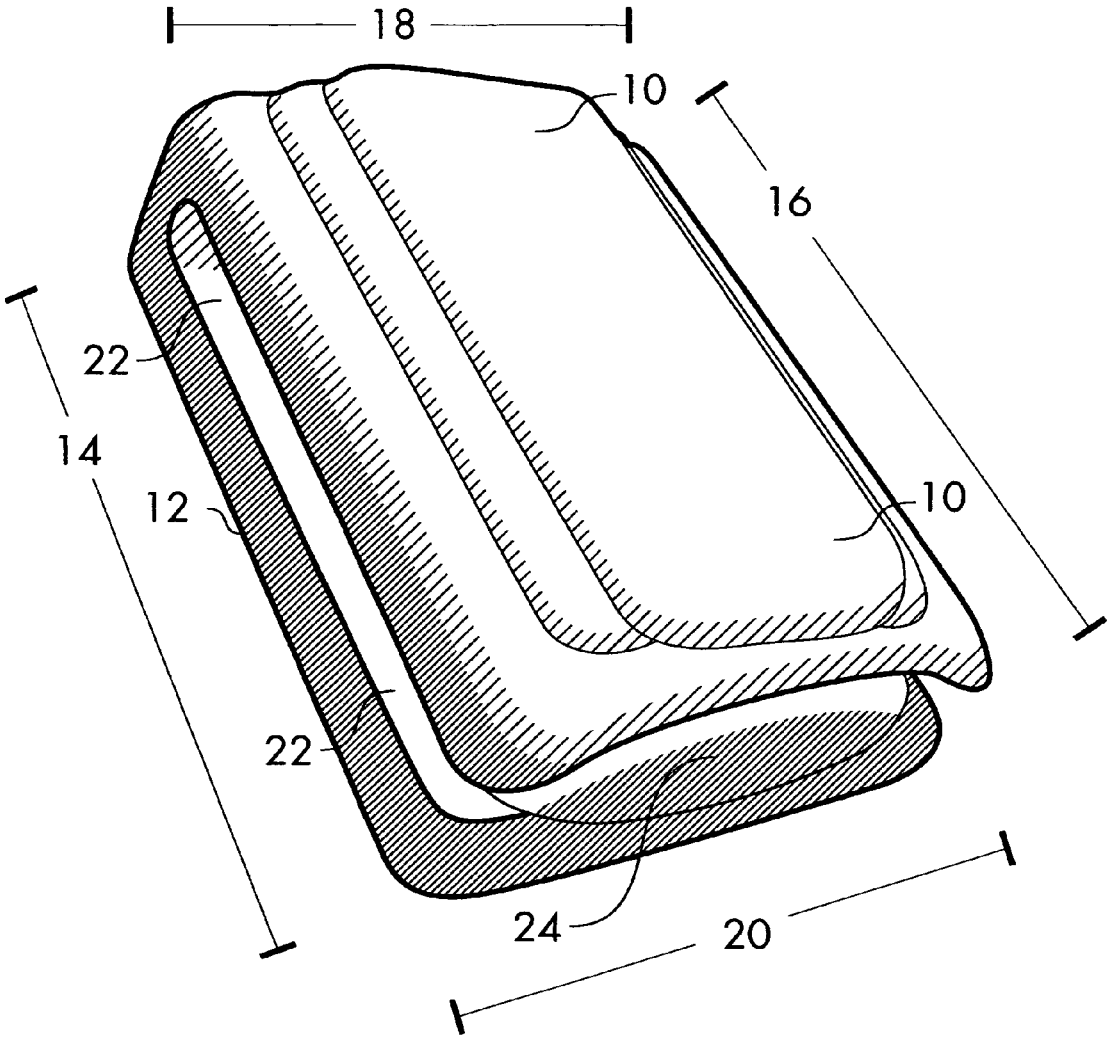
FIG. 2 is a view of the exterior portion of the invention, rotated slightly counterclockwise.

Referring now to the perspective view of the present invention as shown in FIG. 2, there is shown the exterior surface 10, interior surface 12, left side 14, top side 18, bottom side 20 and hollow belt channel 22. The hollow belt channel 22 is open and runs through the invention from the left side 14 to the right side 16. The hollow belt channel 22 is open on the bottom side 20 as well. In the preferred embodiment of the present invention, the hollow belt channel 22 is flat and the bottom side 20 is curved upward, though alternative embodiments may allow for different shapes of the hollow belt channel 22 and bottom side 20.

Figure 3:
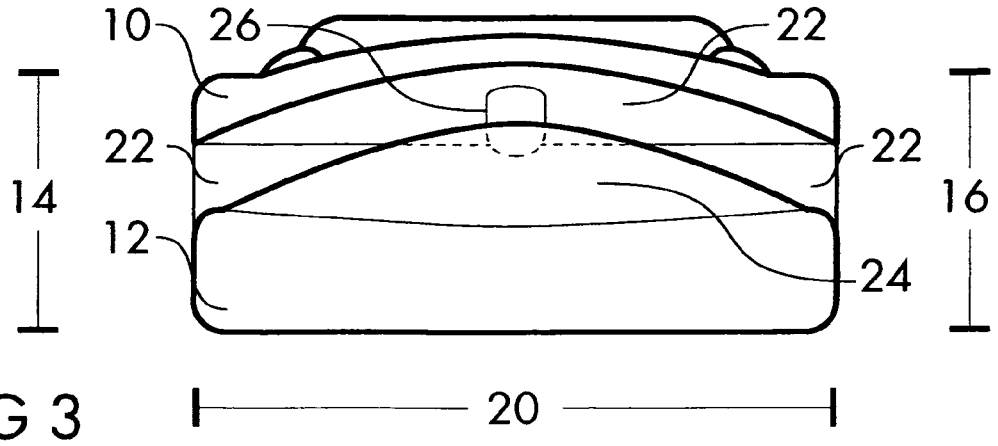
FIG. 3 is a view of the bottom portion of the invention.

Referring now to the view of the present invention as shown in FIG. 3, there is shown the exterior surface 10, interior surface 12, left side 14, right side 16, bottom side 20 and hollow belt channel 22. The preferred embodiment of the present invention calls for the interior surface 12 to rest snugly against the user's wetsuit. The hollow belt channel 22 runs from the left side 14 to the right side 16 and is open at the bottom side 20 as well. The bottom side 20 curves upward at the support lip 24 to assist in holding the present invention on the user's weight belt.

Figure 4:
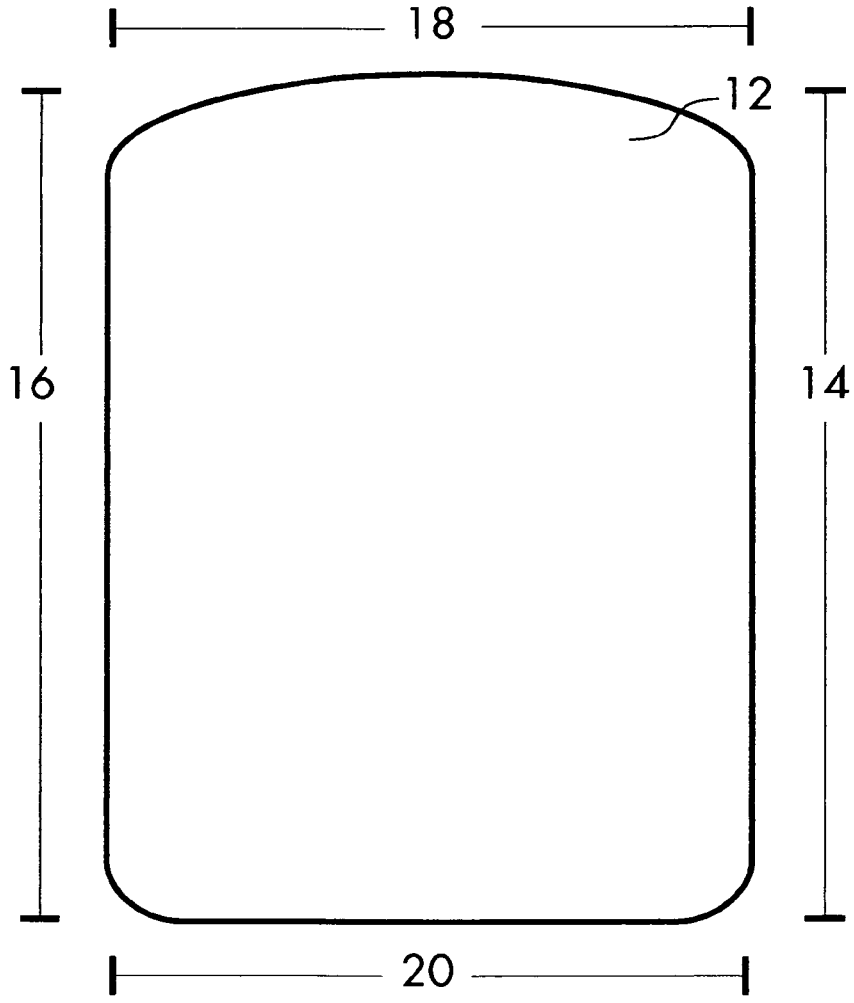
FIG. 4 is a view of the interior portion of the invention.

Referring now to the view of the present invention as shown in FIG. 4, there is shown the interior surface 12, left side 14, right side 16, top side 18 and bottom side.

Figure 5:
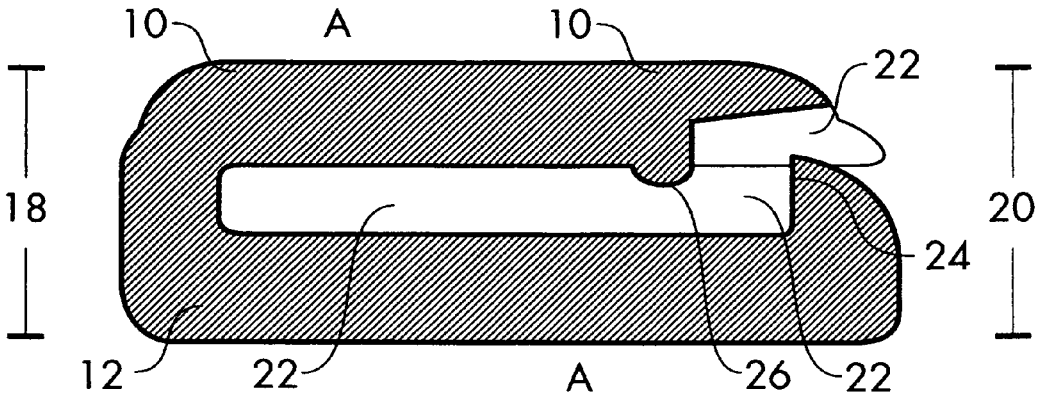
FIG. 5 is a left-side cut-away view of the invention (the right-side view would be a mirror image)

Referring now to the view of the present invention as shown in FIG. 5, there is shown the top side 18, bottom side 20, exterior surface 10, interior surface 12, hollow belt channel 22 and support lip 24. The present invention calls for the user's weight belt to be situated within the hollow belt channel 22. When the user is standing or facing upward, the entire invention rests on the user's weight belt, supported in place by the top side 18. When the user is diving or otherwise inverted, the entire invention rests on the user's weight belt, supported in place by the support lip 24 and the support lip's 24 interaction with the curved portion of the bottom side 20 and the curved sides of the exterior surface 10 near the bottom side 20 of the present invention. Weight belts may feature differing thicknesses. The present invention is designed to work with a range of thicknesses and may feature a raised nub 26 within the hollow belt channel 22 to assist in removing any free play between the user's weight belt and the present invention.

Figure 6:
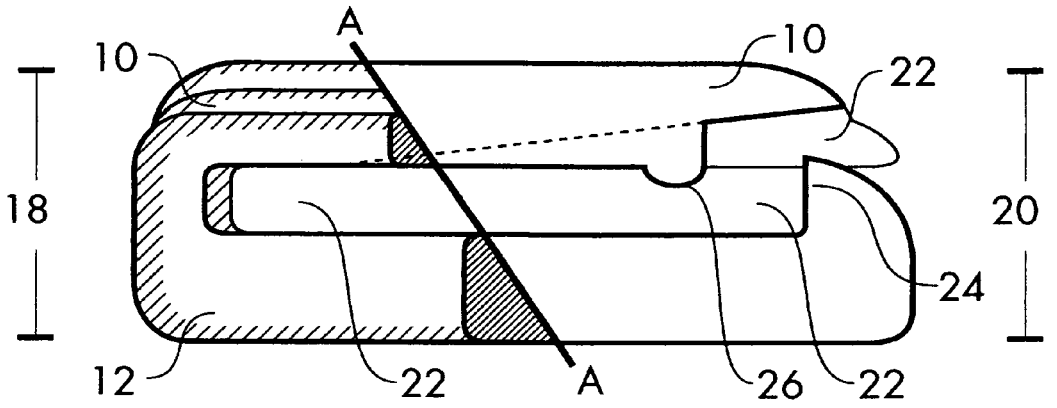
FIG. 6 is a cut-away view of the left side of the invention (the right-side view would be a mirror image of this) taken along the A-A line of FIG. 5.

Referring now to the view of the present invention as shown in FIG. 6, there is shown the exterior surface 10, interior surface 12, left side 14, top side 18, bottom side 20, hollow belt channel 22, support lip 24 and raised nub 26.

Referring in more detail to the portion of the exterior surface 10 closest to the bottom side 20 of the invention, FIGS. 1-3 and FIGS. 5-6 show that the exterior surface 10 curves downward toward the left side 14 and right side 16 along the hollow belt channel 22.

Referring in more detail to the portion of the interior surface 12 closest to the bottom side 20 of the invention, FIGS. 1-3 show that the interior surface 12 curves upward toward the middle of the bottom side 20 along the hollow belt channel 22 and along the support lip 24.

Referring in more detail to the hollow belt channel 22 as show in FIGS. 1-3 and FIGS. 5-6, the hollow belt channel 22 is flat and runs through the present invention from the left side 14 to the right side 16. The top side 18 and support lip 24 run tangentially along the hollow belt channel 22 and hold the present invention in place, regardless of the user's orientation. The nature of the interaction between the hollow belt channel 22, and remaining portions of the present invention (items 10, 12, 14, 16, 18, 20, 24 and 26) is such that the user's weight belt is grasped firmly in place through gravity on the top side 18 and support lip 24, friction and pressure between the weight belt, the hollow belt channel 22 and raised nub 26 and inertia as a whole when the user tightens his/her weight belt. This construction of the present invention as a whole and the placement of its features allow for removal from the user's weight belt by a counterclockwise or clockwise rotation of the present invention toward the left side 14 or right side 16. Once the user has sufficiently rotated the present invention, the support lip 24 and lower side portions of the exterior surface area 10 release their grip on the weight belt and the user is able to easily free the present invention from his or her weight belt. All the user has to do to add additional weight to his/her weight belt is reverse this procedure.

The advantages of the present invention include, without limitation, it allows the user to rapidly and safely add and remove weights without having to remove the weight belt as a whole. The user may do so in any orientation and at any depth in the water column as necessary. Traditional weights must be threaded onto the user's weight belt and can unintentionally come loose and sink when the user removes his or her weight belt to add or remove weights. The present invention reduces this risk and promotes diving safety by offering a quick and easy way to adjust buoyancy without requiring the user to return to shore or a boat.

In broad embodiment, the present invention is a weight for diving weight belts that can be added and removed without necessitating the removal of the user's weight belt.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A one-piece weight for diving, designed for attachment to a diver's person with a diver's weight belt, such weight comprising:

An interior surface and an exterior surface, said surfaces defining the length of the weight;

A top surface and a bottom surface, said surfaces defining the height of the weight;

A left surface and a right surface, said surfaces defining the width of the weight;

A hollow channel running tangential through the left and right surfaces and extending through the bottom surface, said channel extending through the left, right and bottom surfaces along a flat plane;

A curved edge at the juncture of the bottom surface and the exterior surface of the weight, said curve concave to its origin; and A curved and raised lip at the juncture of the bottom surface and the interior surface of the weight, said curve of the raised lip concave to its origin.

2. The diver's weight as set forth in claim 1 further comprising a single raised nub located within the hollow channel.

3. The diver's weight as set forth in claim 2, where the single raised nub is protruding midway between the left and right side of the hollow channel and on the exterior portion of the hollow channel.

4. The diver's weight as set forth in claim 1, where the hollow channel is positioned in a predetermined location through the left, right and bottom surfaces so as to provide firm attachment of the weight to the user's body and prohibit removal of the weight absent rotation about the user's weight belt.

5. The diver's weight as set forth in claim 1 where the junctures of each surface are curved.

* * * * *